US008973477B2

(12) United States Patent
Chang

(10) Patent No.: US 8,973,477 B2
(45) Date of Patent: Mar. 10, 2015

(54) PAPER CUTTING MACHINE

(71) Applicant: Chun Yuan Chang, Taichung (TW)

(72) Inventor: Chun Yuan Chang, Taichung (TW)

( * ) Notice: Subject to any disclaimer, the term of this patent is extended or adjusted under 35 U.S.C. 154(b) by 111 days.

(21) Appl. No.: 13/776,843

(22) Filed: Feb. 26, 2013

(65) Prior Publication Data

US 2014/0238211 A1 Aug. 28, 2014

(51) Int. Cl.
*B26F 1/02* (2006.01)
*B26F 1/36* (2006.01)
*B26D 7/26* (2006.01)

(52) U.S. Cl.
CPC ..... *B26F 1/36* (2013.01); *B26D 7/2614* (2013.01)
USPC ..... 83/468; 83/588; 83/467.1; 83/468.7

(58) Field of Classification Search
CPC ..... B26F 1/32; B26F 1/02; B26F 1/34; B26D 7/22; B26D 7/26
USPC ..... 83/669, 588, 167, 633, 684, 821, 468, 83/563, 618, 698, 522, 571.62, 698.41, 83/692, 686, 693, 691, 467.1, 468.7; 112/475.01
See application file for complete search history.

(56) References Cited

U.S. PATENT DOCUMENTS

| | | | | |
|---|---|---|---|---|
| 2,494,836 | A * | 1/1950 | Segal | 83/167 |
| 5,664,473 | A * | 9/1997 | Huang | 83/620 |
| 6,782,786 | B2 * | 8/2004 | Hoshino | 83/620 |
| D662,137 | S * | 6/2012 | Chuang et al. | D19/72 |
| 2007/0234866 | A1 * | 10/2007 | Kandasamy et al. | 83/588 |
| 2007/0295184 | A1 * | 12/2007 | Mori et al. | 83/684 |

* cited by examiner

*Primary Examiner* — Ghassem Alie

(57) ABSTRACT

A paper cutting machine contains a base, a holder, a connecting member, a driving member, a cutting member, and a protective cover covered on the holder. The base includes four first holes, a second hole, a first slot, and a second slot. The holder includes two first orifices, two second orifices, and a covering seat. The connecting member connects with a first bolt of the holder and includes a press bar, a reinforcement bar, and a handle. The driving member includes a first aperture, a seat, a recess, and a second aperture. The cutting member includes an inserting piece and a cutout and is placed into the recess and is fixed by screwing the positioning rod into the cutout. The first bolt has two torsion springs, one end of each torsion spring abuts against the press bar, another end of the each torsion spring pushes against the second bolt.

10 Claims, 9 Drawing Sheets

PAPER CUTTING MACHINE

FIELD OF THE INVENTION

The present invention relates to a paper cutting machine which changes using types and replaces different types of cutting members so as to cut corners or sides of papers and to cut holes on the papers.

BACKGROUND OF THE INVENTION

A conventional paper cutting machine is used to cut corners of papers without cutting sides of the papers. In addition, the conventional paper cutting machine has a fixed cutter without replacing different types of cutters.

SUMMARY OF THE INVENTION

The primary object of the present invention is to provide a paper cutting machine which changes using types and replaces different types cutting members so as to cut corners or sides of papers and to cut holes on the papers To obtain the above objectives, a paper cutting machine provided by the present invention contains: a base, a holder, a connecting member, a driving member, a cutting member, and a protective cover.

The base includes four first holes defined thereon so as to insert two stopping pieces by ways of four pegs of the two stopping pieces, a second hole formed thereon so as to receive a deck, a third hole arranged behind the second hole, a first slot defined below the third hole so as to receive a chip collecting box, and a second slot formed on a bottom end of a front side of the base so as to receive a case.

The holder is disposed above the second orifice of the base and includes two first orifices formed on two upper ends of two sides thereof so as to insert a first bolt, two second orifices defined on two middle sections of the two sides thereof so as to fix a second bolt, and a covering seat locked on a front side of the holder so as to define a groove between the covering seat and the holder.

The connecting member connects with the first bolt of the holder and includes a press bar mounted on two lower ends of two sides thereof, a reinforcement bar fixed above the press bar, and a handle secured on two upper ends of the two sides thereof.

The driving member is disposed in the groove of the holder and includes a first aperture formed thereon so as to insert the press bar, a seat coupled with a lower end thereof, a recess defined in the seat, and a second aperture arranged at a central position of a front end of the seat so as to fix a positioning rod.

The cutting member includes an inserting piece, a cutout defined on the inserting piece such that the cutting member is placed into the recess of the seat and is fixed by screwing the positioning rod into the cutout.

The first bolt has two torsion springs mounted thereon, and one end of each torsion spring abuts against the press bar, another end of the each torsion spring is biased against the second bolt.

The protective cover is covered on the holder.

DETAILED DESCRIPTION OF THE PREFERRED EMBODIMENTS

Figure 1:
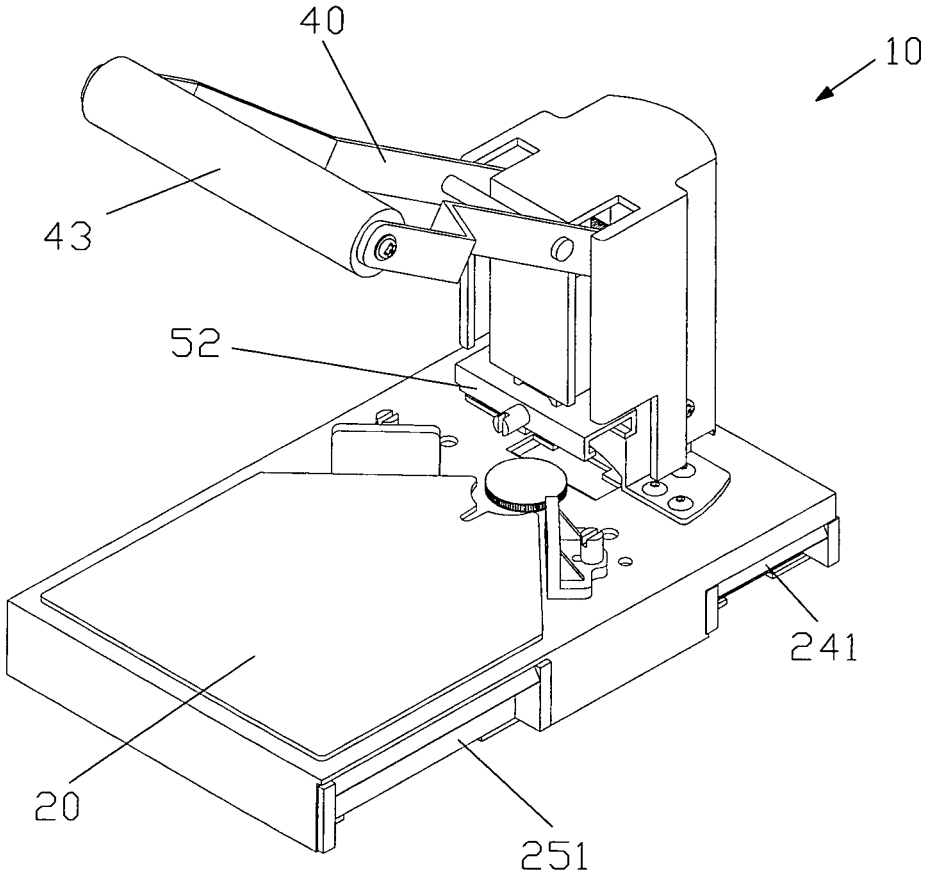
FIG. 1 is a perspective view showing the assembly of a paper cutting machine according to a first embodiment of the present invention.
Figure 2:
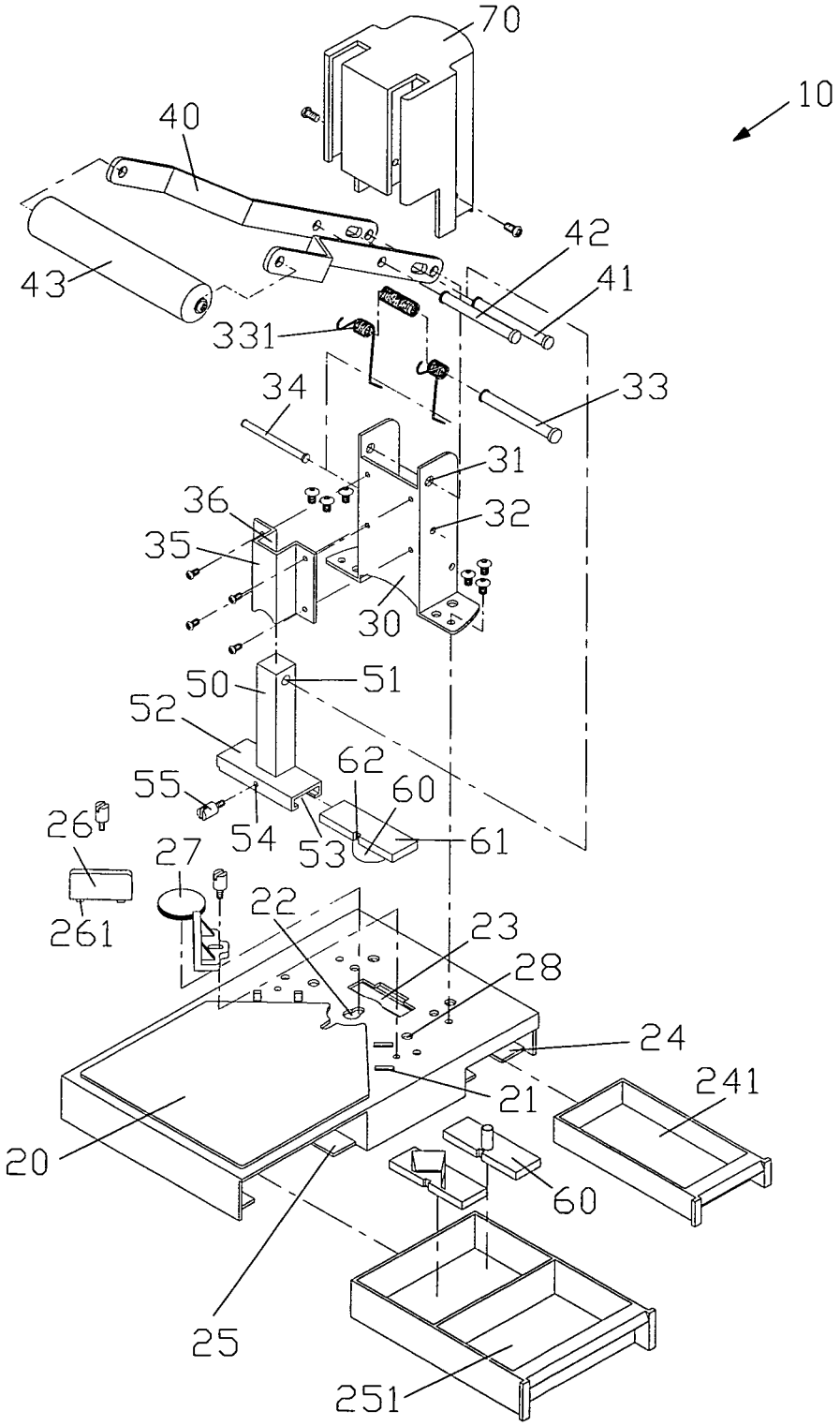
FIG. 2 is a perspective view showing the exploded components of the paper cutting machine according to the first embodiment of the present invention.
Figure 3:
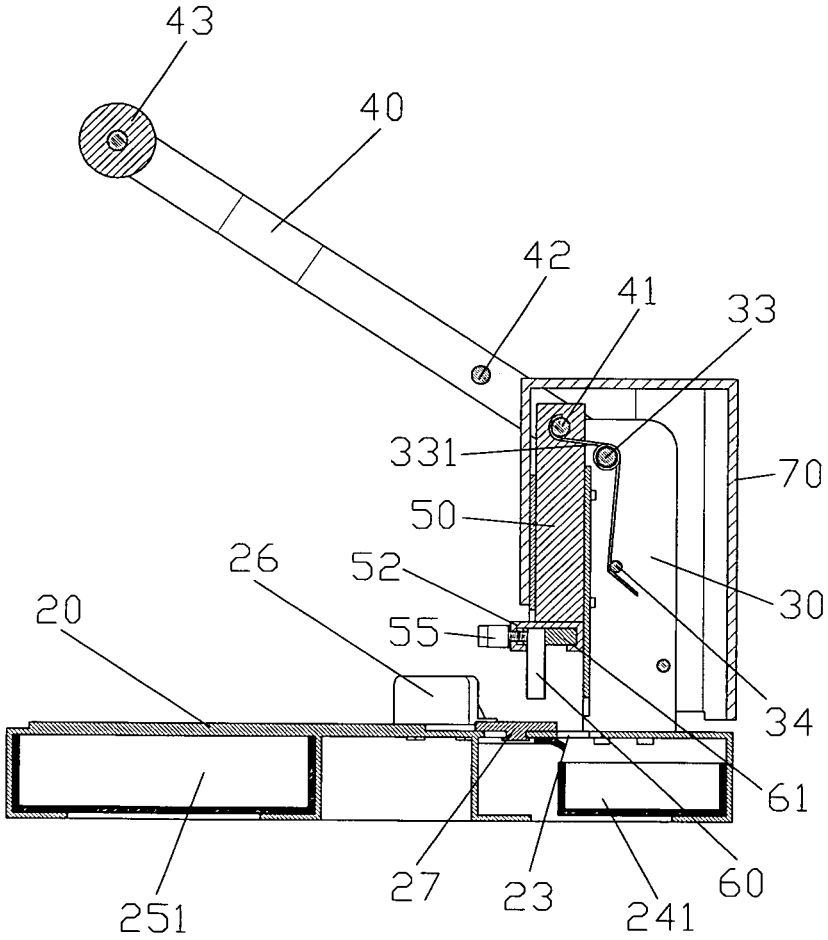
FIG. 3 is a cross sectional view showing the assembly of the paper cutting machine according to the first embodiment of the present invention.

Referring to FIGS. 1-3, a paper cutting machine 10 according to a first embodiment of the present invention comprises a base 20, a holder 30, a connecting member 40, a driving member 50, a cutting member 60, and a protective cover 70.

The base 20 includes four first holes 21 defined thereon so as to insert two stopping pieces 26 by ways of four pegs 261 of the two stopping pieces 26, a second hole 22 formed thereon so as to receive a deck 27, a third hole 23 arranged behind the second hole 22, a first slot 24 defined below the third hole 23 so as to receive a chip collecting box 241, and a second slot 25 formed on a bottom end of a front side of the base 20 so as to receive a case 251.

The holder 30 is disposed above the second orifice 23 of the base 20 and includes two first orifices 31 formed on two upper ends of two sides thereof so as to insert a first bolt 33, two second orifices 32 defined on two middle sections of the two sides thereof so as to fix a second bolt 34, and a covering seat 35 locked on a front side of the holder 30 so as to define a groove 36 between the covering seat 35 and the holder 30.

The connecting member 40 connects with the first bolt 33 of the holder 30 and includes a press bar 41 mounted on two lower ends of two sides thereof, a reinforcement bar 42 fixed above the press bar 41, and a handle 43 secured on two upper ends of the two sides thereof.

The driving member 50 is disposed in the groove 36 of the holder 30 and includes a first aperture 51 formed thereon so as to insert the press bar 41, a seat 52 coupled with a lower end thereof, a recess 53 defined in the seat 52, and a second aperture 54 arranged at a central position of a front end of the seat 52 so as to fix a positioning rod 55.

The cutting member 60 includes an inserting piece 61 and a cutout 62 defined on the inserting piece 62 such that the cutting member 60 is placed into the recess 53 of the seat 52 and is fixed by screwing the positioning rod 55 into the cutout 62. In addition, the first bolt 33 has two torsion springs 331 mounted thereon, and one end of each torsion spring 331 abuts against the press bar 41, another end of the each torsion spring 331 is biased against the second bolt 34.

The protective cover 70 is covered on the holder 30.

Figure 4:
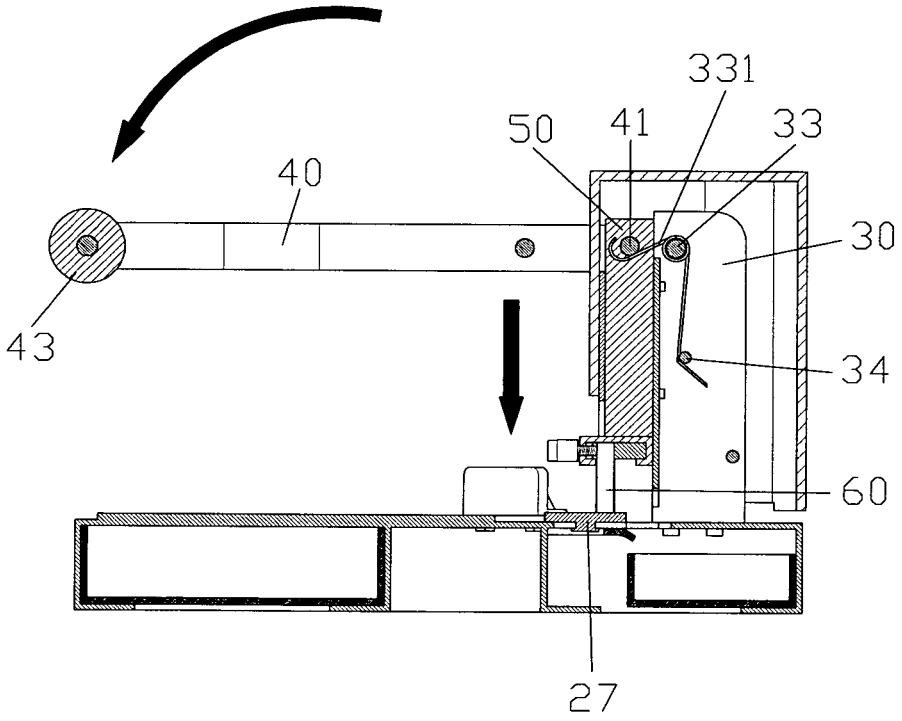
FIG. 4 is a cross sectional view showing the operation of the paper cutting machine according to the first embodiment of the present invention

Referring further to FIGS. 3 and 4, in operation, the handle 43 is pressed downwardly, the press bar 41 is driven by the handle 43 to move to press the driving member 50 downwardly, such that the cutting member 60 is pressed by the driving member 50 so as to cut papers (not shown) on the deck 27. Thereafter, the two torsion springs 331 push the press bar 41 upwardly so that the connecting member 40 moves back to an original position, and cut chips of the papers fall into the chip collecting box 241 via the third hole 23. Furthermore, the case 251 is used to place different types of cutting members 60. Also, the cutting member 60 is removed quickly by unscrewing the positioning rod 55 from the cutout 62 so as to replace another cutting member easily.

Figure 5:
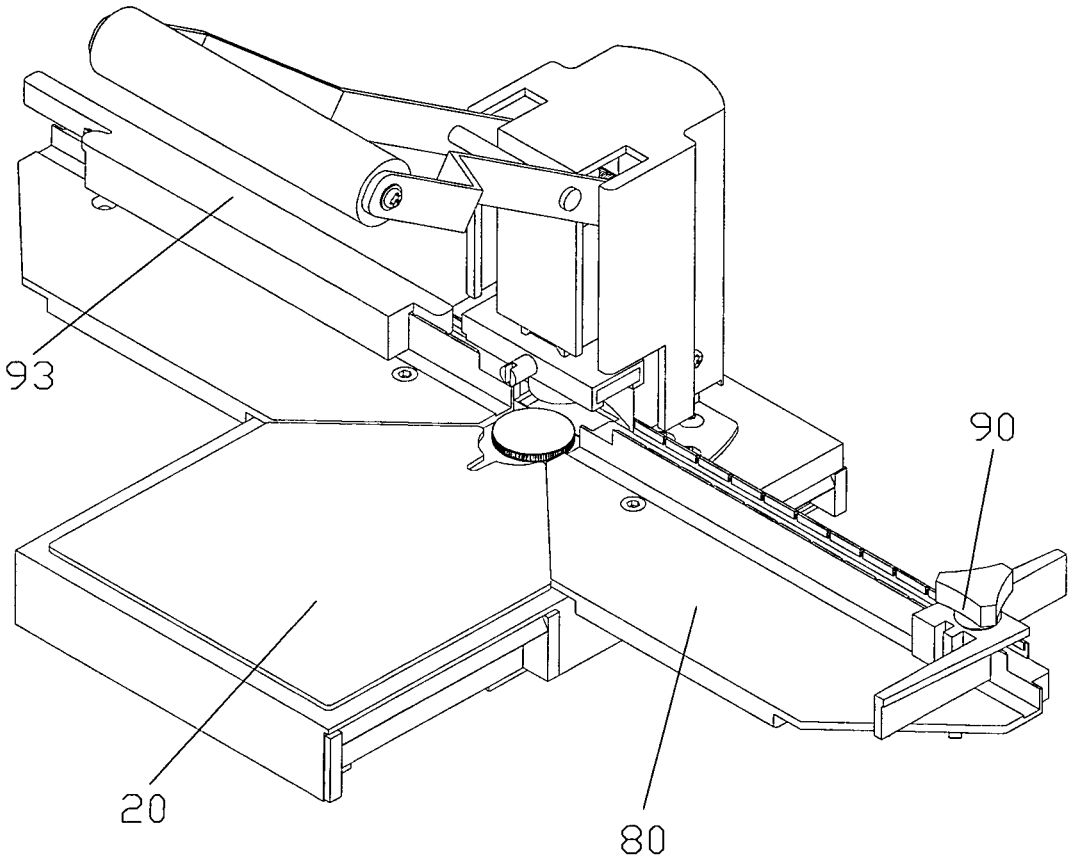
FIG. 5 is a perspective view showing the assembly of a paper cutting machine according to a second embodiment of the present invention.
Figure 6:
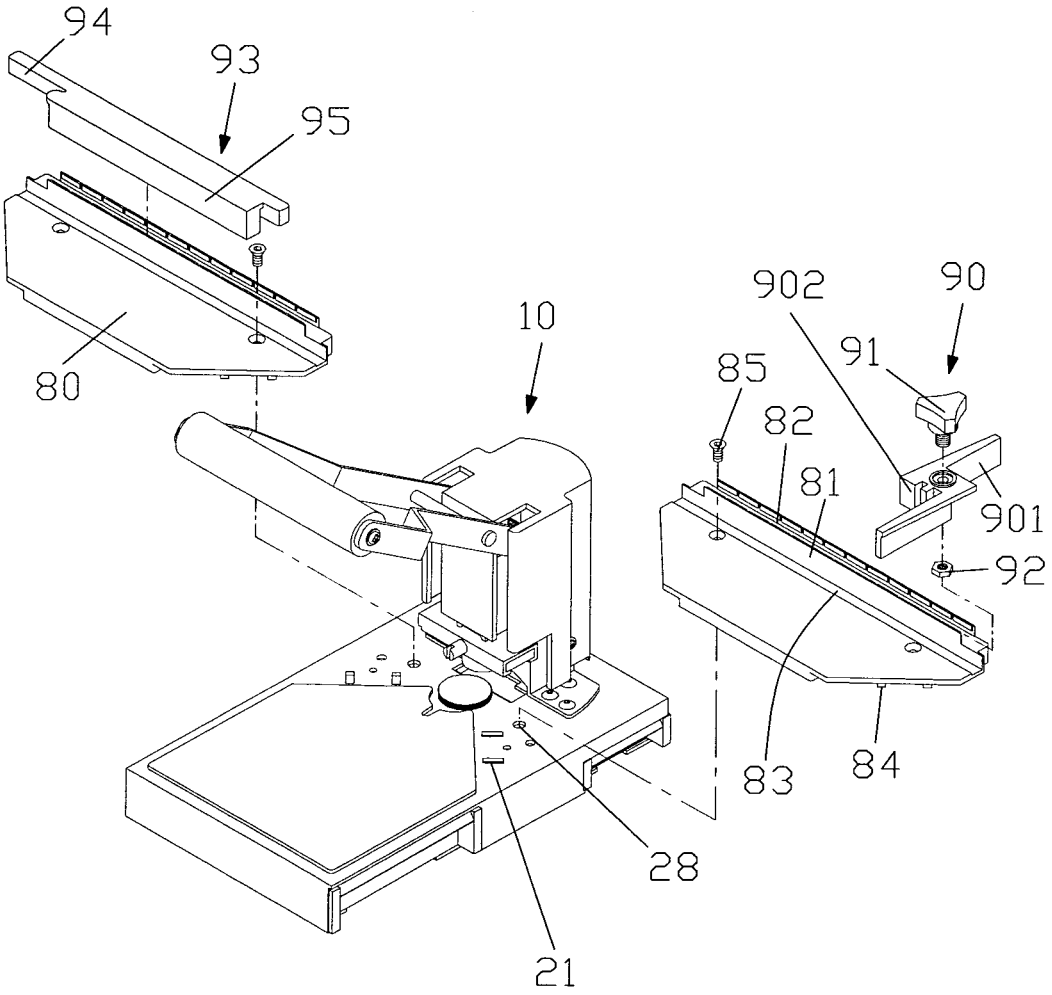
FIG. 6 is a perspective view showing the assembly of two holing plates of the paper cutting machine according to the second embodiment of the present invention.
Figure 7:
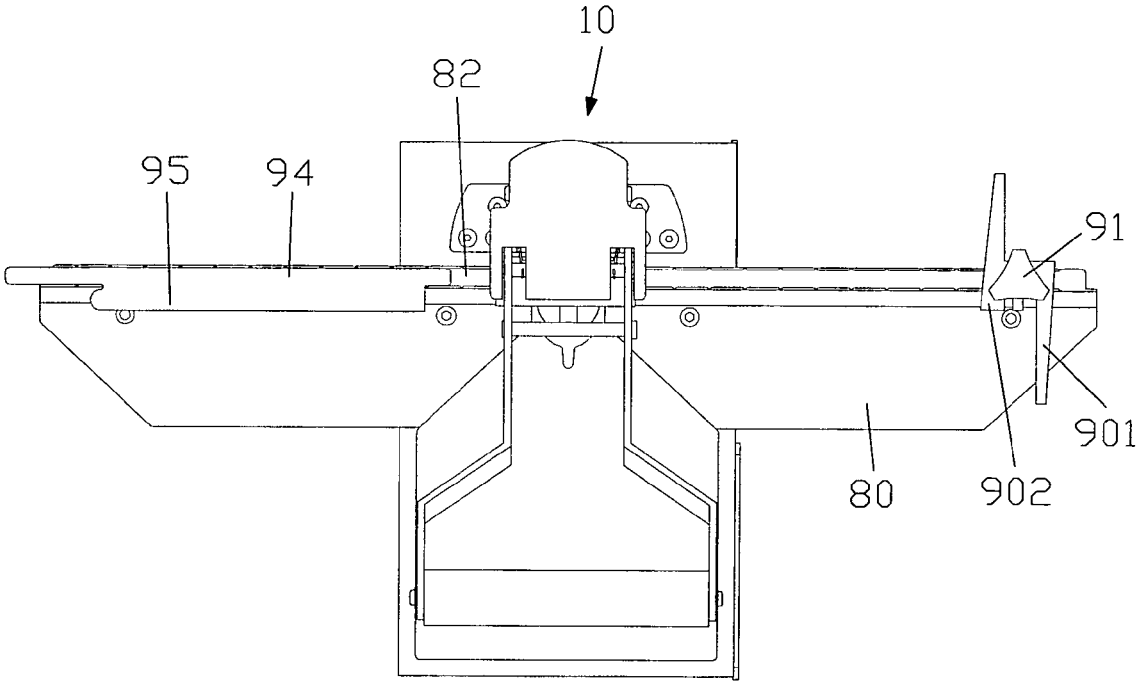
FIG. 7 is a plan view showing the operation of the paper cutting machine according to the second embodiment of the present invention.
Figure 8:
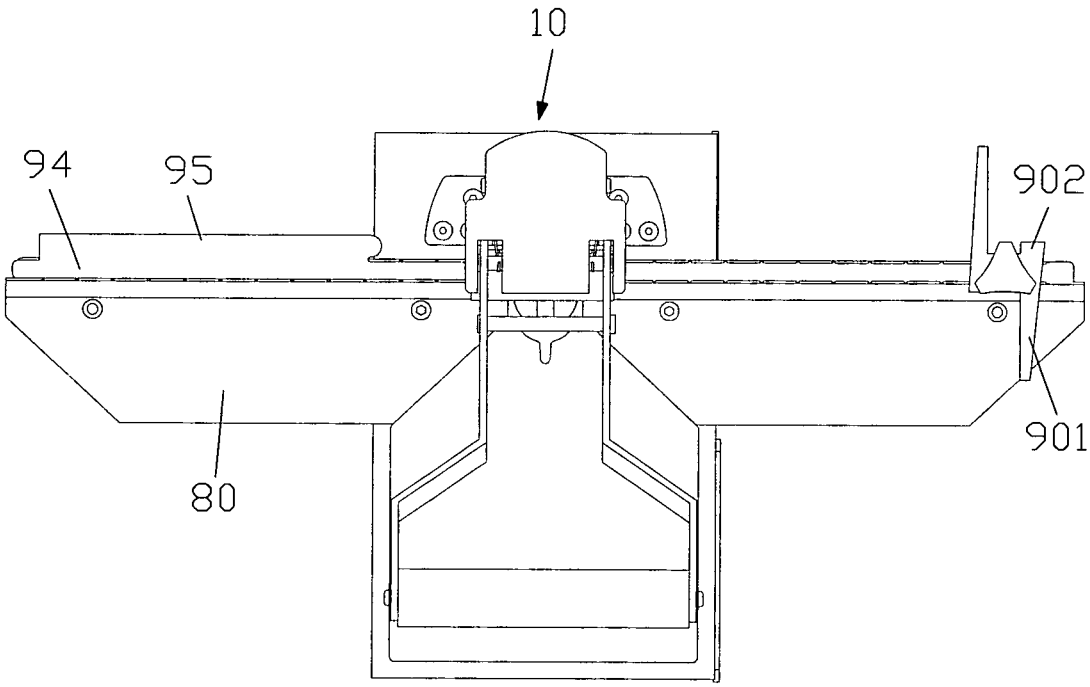
FIG. 8 is another plan view showing the operation of the paper cutting machine according to the second embodiment of the present invention.
Figure 9:
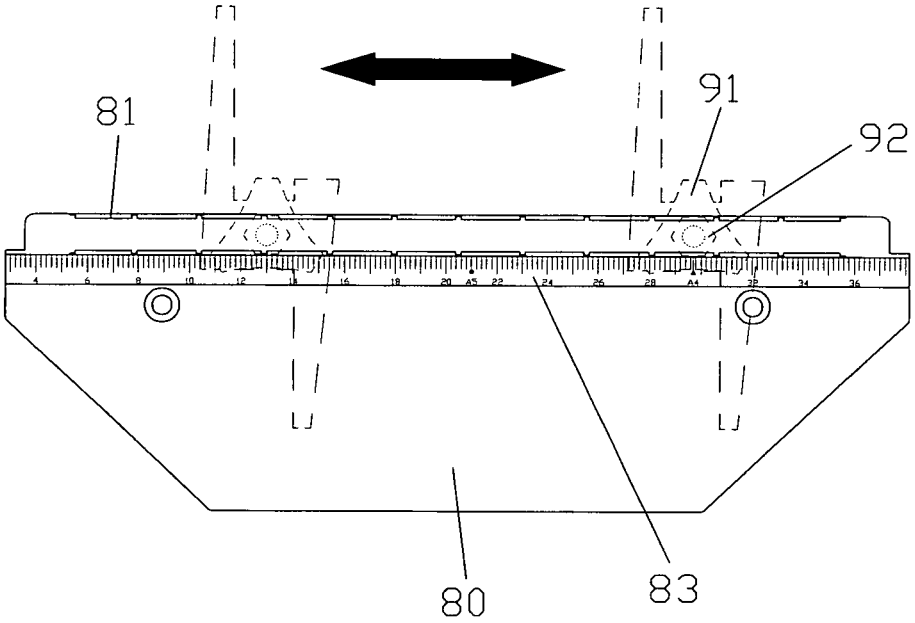
FIG. 9 is also another plan view showing the operation of the paper cutting machine according to the second embodiment of the present invention.

As shown in FIGS. 5 and 6, the two stopping pieces 26 are replaced by two holding plates 80 according to a second embodiment of the present invention, wherein each holding plate 80 includes two pegs 84 extending outwardly from a bottom end thereof so as to connect with two of the four first holes 21, a screw bolt 85 for screwing the each holding plate 80 with a respective one of two openings 28 of the base 20, an elongated panel 81 formed on a rear end of the each holding plate 80, an elongated trench 82 defined in the elongated panel 81 of the each holding plate 80 so as to insert a connector 93 or a limiting member 90, and a notch 83 arranged on a front end of the elongated panel 81.

As illustrated in FIGS. 6-9, the connector 93 has an insertion 94 inserted into the elongated trench 82 and a rib 95 formed on a front end thereof. The limiting member 90 is placed on the elongated panel 81 and is locked with a nut 92 in the elongated trench 82 by ways of a locking element 91, and the limiting member 90 includes two stoppers 901 extending outwardly from two sides thereof and a shoulder 902 defined on one of the two stoppers 901, such that the limiting member 90 is fixed on the elongated panel 81.

Thereby, when the two holding plates 80 are fixed on the base 20, the paper cutting machine 10 is applied to cut corners of parallel papers (not shown), and when the rib 95 of the connector 93 is placed on the front end of the elongated panel 81, another of the two holding plates 80 is served to fix the one of the two stoppers 901 which has the shoulder 902 on the front end of the elongated panel 81. On the contrary, when the rib 95 of the connector 93 is placed on a rear end of the elongated panel 81, the another holding plate 80 is applied to fix another stopper 901 which does not have the shoulder 902 on the front end of the elongated panel 81 so that the papers are located at the same horizontal position, thus adjusting a cutting position and a cutting distance of the papers. Preferably, a size marker is provided in the notch 83 of the each holding plate 80 and moves relative to the locking element 91, thus cutting the papers precisely.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A paper cutting machine comprising:

a base, a holder, a connecting member, a driving member, a cutting member, and a protective cover; wherein the base includes four first holes defined thereon so as to insert two stopping pieces by ways of four pegs of the two stopping pieces, a second hole formed thereon so as to receive a deck, a third hole arranged behind the second hole, a first slot defined below the third hole so as to receive a chip collecting box, and a second slot formed on a bottom end of a front side of the base so as to receive a case;

the holder is disposed above the second hole of the base and includes two first orifices formed on two upper ends of two sides thereof so as to insert a first bolt, two second orifices defined on two middle sections of the two sides thereof so as to fix a second bolt, and a covering seat locked on a front side of the holder so as to define a groove between the covering seat and the holder;

the connecting member connects with the first bolt of the holder and includes a press bar mounted on two lower ends of two sides thereof, a reinforcement bar fixed above the press bar, and a handle secured on two upper ends of the two sides thereof;

the driving member is disposed in the groove of the holder and includes a first aperture formed thereon so as to insert the press bar, a seat coupled with a lower end thereof, a recess defined in the seat, and a second aperture arranged at a central position of a front end of the seat so as to fix a positioning rod;

the cutting member includes an inserting piece, a cutout defined on the inserting piece such that the cutting member is placed into the recess of the seat and is fixed by screwing the positioning rod into the cutout;

the first bolt has two torsion springs mounted thereon, and one end of each torsion spring abuts against the press bar, another end of the each torsion spring is biased against the second bolt;

the protective cover is covered on the holder.

2. The paper cutting machine as claimed in claim 1, wherein the two stopping pieces are replaced by two holding plates, and each holding plate includes two pegs extending outwardly from a bottom end thereof so as to connect with two of the four first holes, a screw bolt for screwing the each holding plate with a respective one of two openings of the base.

3. The paper cutting machine as claimed in claim 2, wherein the each holding plate also includes an elongated panel formed on a rear end thereof, an elongated trench defined in the elongated panel thereof so as to insert a connector or a limiting member, and a notch arranged on a front end of the elongated panel.

4. The paper cutting machine as claimed in claim 3, wherein the connector has an insertion inserted into the elongated trench and a rib formed on a front end thereof.

5. The paper cutting machine as claimed in claim 3, wherein the limiting member is placed on the elongated panel and is locked with a nut in the elongated trench by ways of a locking element, and the limiting member includes two stoppers extending outwardly from two sides thereof and a shoulder defined on one of the two stoppers, such that the limiting member is fixed on the elongated panel.

6. The paper cutting machine as claimed in claim 4, wherein the rib of the connector is placed on the front end or a rear end of the elongated panel.

7. The paper cutting machine as claimed in claim 5, wherein when the rib of the connector is placed on the front end of the elongated panel, another of the two holding plates is served to fix the one of the two stoppers which has the shoulder on the front end of the elongated panel, and when the rib of the connector is placed on a rear end of the elongated panel, the another holding plate is applied to fix another stopper which does not have the shoulder on the front end of the elongated panel.

8. The paper cutting machine as claimed in claim 3, wherein a size marker is provided in the notch of the each holding plate and moves relative to the locking element.

9. The paper cutting machine as claimed in claim 5, wherein the limiting member is fixed on the elongated panel.

10. The paper cutting machine as claimed in claim 1, wherein the case is used to place different types of cutting members.

* * * * *